US005129656A

United States Patent [19]

Marte et al.

[11] Patent Number: 5,129,656

[45] Date of Patent: Jul. 14, 1992

[54] RACQUET, IN PARTICULAR A TENNIS RACQUET

[75] Inventors: Robert Marte, Götzis; Helmut Umlauft, Hard, both of Austria

[73] Assignee: Head Sportgerate Gesellschaft m.b.H. & Co. OHG, Wuhrkopfweg, Austria

[21] Appl. No.: 735,511

[22] Filed: Jul. 26, 1991

[30] Foreign Application Priority Data

Jul. 31, 1990 [AT] Austria ..... 1609/90

[51] Int. Cl.[5] ..... A63B 49/08

[52] U.S. Cl. ..... 273/73 J; 273/81 R

[58] Field of Search ..... 273/73 J, 75, 81 B, 273/81 D, 81 R, 165, 81.2

[56] References Cited

U.S. PATENT DOCUMENTS

| | | | |
|---|---|---|---|
| 1,563,780 | 12/1925 | Ovenshire | 273/73 J |
| 3,833,219 | 9/1974 | Dean | 273/73 J X |
| 4,609,198 | 9/1986 | Tarr | 273/73 J |
| 4,819,939 | 4/1989 | Kobayashi | 273/81.2 X |
| 4,907,810 | 3/1990 | Whiteford | 273/73 J |
| 5,034,082 | 7/1991 | Nolan | 273/73 J X |

FOREIGN PATENT DOCUMENTS

| | | | |
|---|---|---|---|
| 2454431 | 8/1976 | Fed. Rep. of Germany . | |
| 3344329 | 6/1985 | Fed. Rep. of Germany | 273/73 J |
| 3510598 | 9/1986 | Fed. Rep. of Germany . | |
| 470891 | 4/1969 | Switzerland . | |
| 2230458 | 10/1990 | United Kingdom | 273/73 J |

*Primary Examiner*—Benjamin Layno
*Assistant Examiner*—William E. Stoll
*Attorney, Agent, or Firm*—Nixon & Vanderhye

[57] ABSTRACT

In a racquet, in particular, a tennis racquet, which incorporates a frame, an open or closed heart piece, and a shaft (2) that is joined to the heart piece, with the frame, heart piece and shaft being formed in one piece or connected releasably to each other, the grip (1) that is formed as a one-piece sleeve can be slid onto the shaft. The inside profile of the cross section of the grip (1) and the outside profile of the cross section of the shaft (2) incorporate longitudinal shape-locking and interacting supporting surfaces. The spacing between the supporting surfaces on the shaft (2) and the supporting surfaces of the grip (1) tapers in a wedge shape towards the unattached end (11) of the shaft (2). A removable distance piece (3) that prevents the grip (1) being slid axially into the mated position is releasably connected to the end (11) of the shaft. With the distance piece (3) installed on the shaft, the racquet can be tested with various grips (1). After removal of the distance piece (3) the grip is slid completely onto the shaft (2) and is then joined to the shaft so that, for all practical purposes, it cannot be released from the shaft.

16 Claims, 4 Drawing Sheets

RACQUET, IN PARTICULAR A TENNIS RACQUET

Figure 1:
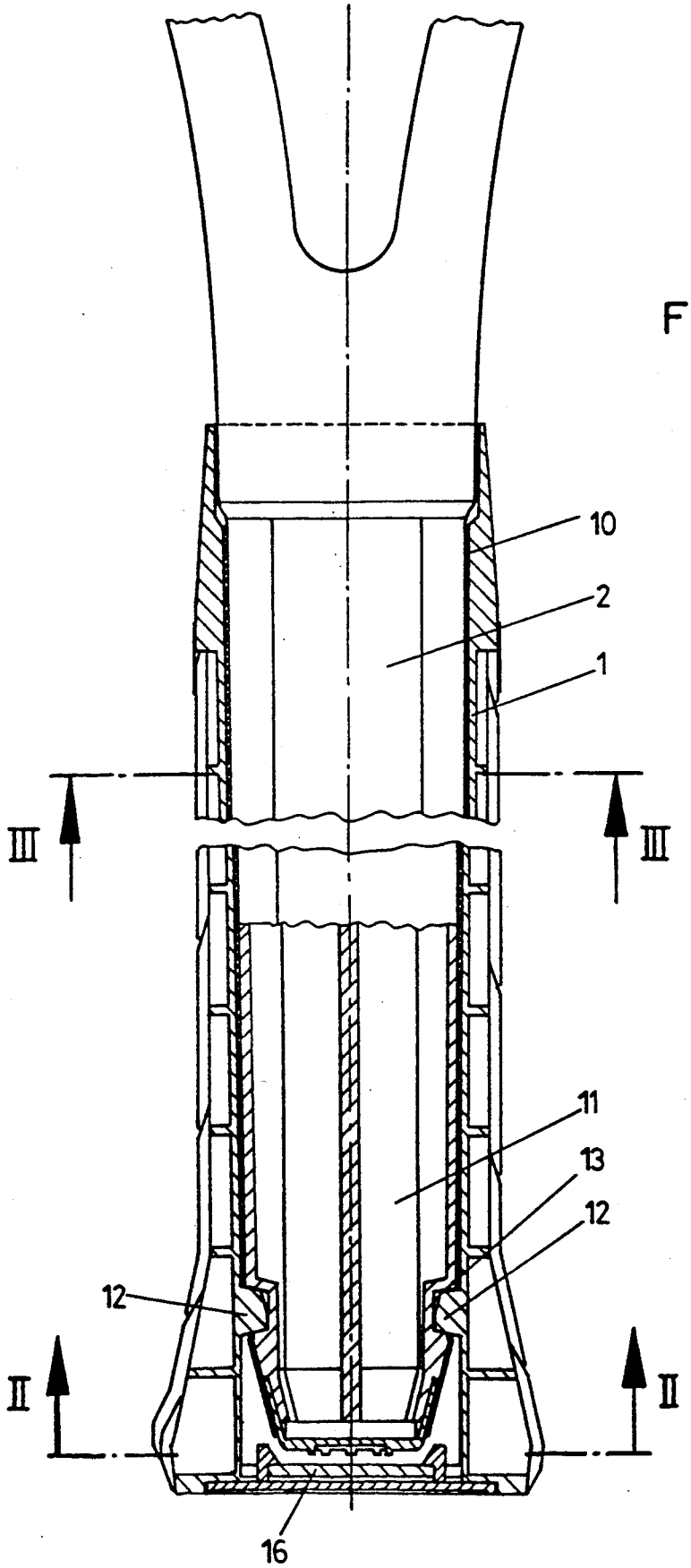

The present invention relates to a racquet, in particular to a tennis racquet that consists of a frame, an open or closed heart piece, a shaft that adjoins the heart piece, the frame, heart piece and shaft being manufactured as one piece or being connected to each other so as to be fixed, and with a grip that is formed as a one-piece sleeve that can be slid onto the shaft and secured thereon when in the fully installed mated position, the inside profile of the cross section of the grip and the outside profile of the cross section of the shaft incorporating supporting surfaces that are a shape-locking fit with each other and extend longitudinally over at least part of the length of the shaft, by means of which the grip is secured on the shaft in such a manner that it cannot rotate independently of said shaft, and wherein, on the one hand, the supporting surfaces of the shaft and, on the other hand, the supporting surfaces of the grip converge in a wedge shape at least over a part of the length of the grip in the direction of the unattached end of the shaft, and the supporting surfaces of the grip are parallel to the wedge surfaces of the shaft that work in conjunction with them. Such a configuration entails the advantage that one can combine any frame with a heart piece and shaft with any grip. The purchaser can select the frame with its heart piece and shaft to be of the weight that is desired, and can select the grip to fit a particular size of hand, when the dealer can then assemble these two parts. This brings about a considerable reduction of inventory. DE-OS 19 59 368 and DE-OS 24 54 431 describe a racquet, in which a grip can be slid onto a shaft. As described in DE-OS 19 59 368, the shaft and the grip are configured so as to have supporting surfaces that are parallel to each other and when in the mated position the grip is secured to the shaft only means of a transverse screw. Such a transverse screw is not equal to the exacting demands in order to ensure a safe, tight, and rigid connection of the grip with the shaft. According to DE-OS 24 54 431, the supporting surfaces of the shaft and of the grip extend in a wedge shape and converge towards the end of the shaft, and when it is in the fully installed mated position the grip is secured to the shaft by detents and cannot be released. However, the purchaser must be able to try out the racquet using different grips when at the dealer's. However, if the grip is secured to the shaft during this test and is unreleasable for all practical purposes, then it is not possible to remove the grip from the shaft after the first trial.

It is the aim of the present invention to arrive at a configuration that ensures that the grip can be secured to the shaft in the mated position so as to satisfy very exacting demands, and which, despite this, permits the simple removal of the grip from the shaft after a trial. In order to do this, the present invention is essentially such that between the shaft and the grip there is a removable distance piece that limits the axial installment movement of the grip and prevents the grip being fully installed in the mated position. Because of the fact that this removable distance piece prevents such a complete installation into the mated position, the grip can be easily removed after a trial. Only after the satisfactory outcome of a trial is the distance piece removed and the grip pressed securely onto the shaft. As a consequence of the wedge-shaped taper, the grip can be seated securely enough on the shaft for a trial even before the removal of the distance piece, during the trial. The grip can be in the form of a prefabricated grip with the [non-slip]binding already installed. It is expedient that the shaft and the hollow space within the grip be tapered evenly essentially to the whole length of the grip. This ensures not only the secure and tight connection of the grip to the shaft when in the completely installed mated position, such as to satisfy the most exacting demands; it will, above all, ensure a sufficiently secure installation of the grip for the trial as long as the distance piece prevents the grip from being completely installed.

According to the present invention, it is expedient that the distance piece be connected to the shaft or to the grip so as to be releasable. This simplifies testing and above all it will prevent the dealer forgetting to the install the distance piece during the trial and then being unable to remove the grip without causing severe damage to it. According to the present invention, it is preferred that the distance piece be connected to the unattached end of the shaft so as to be releasable, and so as to rest against a stop surface of the grip. This is advantageous because the unattached end of the shaft is accessable. The distance piece can be connected to the unattached end of the shaft by means of a screw. However, in this case, it is once again necessary to use a tool in order to release the distance piece from the end of the shaft. According to a preferred embodiment of the present invention, for this reason the distance piece is connected to the unattached end of the shaft through a nominal break section so that it can be broken away from the end of the shaft very easily. However, the distance piece can also be mounted on the free end of the shaft, or plugged into this.

It is expedient that the grip be connected unreleasably to the shaft when in the mated position. According to a preferred embodiment of the present invention, after the distance piece has been removed from the shaft or the grip, the grip can be secured in the mated position by means of a snap-in detent in the area of the shaft end. For all practical purposes, such a connection cannot be released without destroying the grip, or at least damaging it, because the location of the detent is not accessible. According to the present invention, it is expedient that the snap-in detent be formed by at least one, preferably two, diametrically opposed lugs on the inner surface of the grip, and by at least one groove on the shaft that runs transversely to the axis thereof, the grip consisting of elastically deformable material. In this way, there is no need for a separate spring for the detent and the rigidity of the connection is improved. Also according to the present invention, it is expedient that the lug and the groove be defined axially by defining surfaces that are transverse to the axis of the shaft, the spacing of the defining surfaces of the lug corresponding to the spacing between the defining surfaces of the groove. This entails the added advantage that the grip is secured to the shaft in both axial directions by the detent itself. However, according to the present invention, the unattached end of the shaft can be hollow and be of an elastically deformable material, and incorporate at least one, but preferably two, diametrically opposed lugs, which snap behind a step that is formed on the inside surface of the grip.

The rigid connection of the grip to the shaft can also be effected by adhesives. In this case, it is expedient to arrange a capsule or bag which contains a quantity of adhesive within the grip; this is cut or punctured by a blade or pin when the grip is slid into the mated position after removal of the distance piece. The distance piece prevents the capsule or bag being destroyed when the grip is installed for the trial and the blade or the pin only reaches the capsule or the bag when the grip is slid all the way onto the shaft into the mated position, so that the capsule or bag is destroyed and the adhesive can flow out of it.

According to a preferred embodiment of the present invention, the angle of the taper that is subtended between the supporting surfaces is self-locking. According to the present invention, the angle of taper that is subtended between the supporting surfaces is at most 3°, and preferably approximately 1°.

Such an angle of taper ensures, on the one hand, the firm seating of the grip on the shaft when the distance piece has been removed when in the mated position and, on the other hand, sufficiently firm seating of the grip on the shaft during the trial, even with the distance piece in its proper position.

According to the present invention, it is preferred that the distance piece be of such a size that the installation movement of the grip amounts expediently to approximately 99% of the total installation path into the mated position, with the distance piece removed. This, too, ensures a sufficiently firm seating of the grip on the shaft for the trial with the distance piece in position and during the trial the position of the distance piece on the shaft is similarly to its position when in the mated position.

Figure 3:
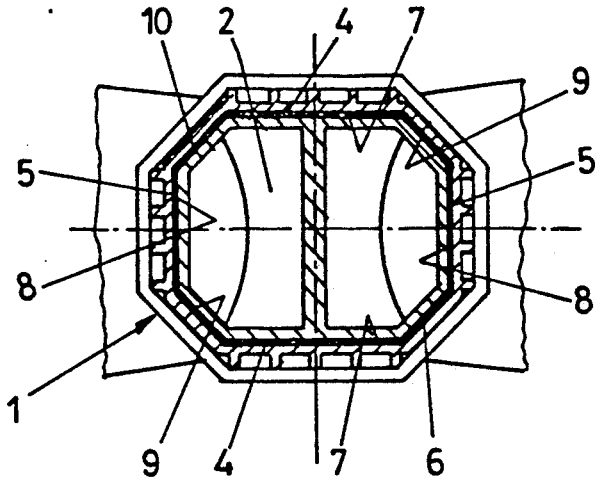
Figure 2:
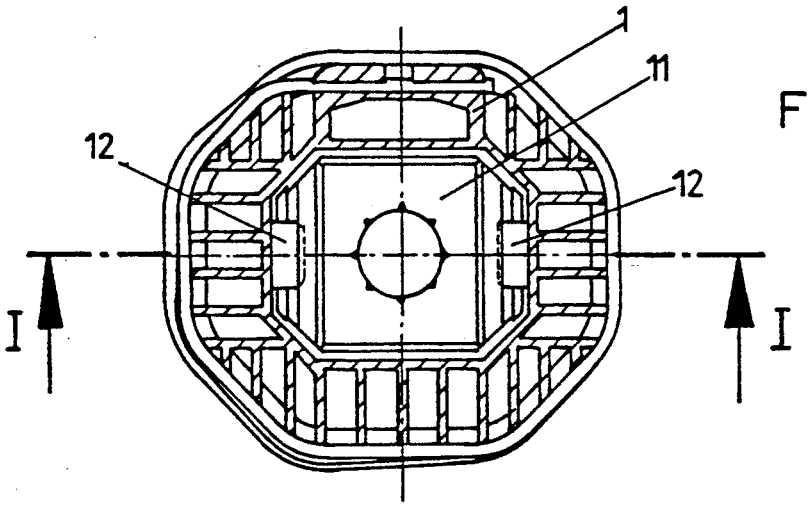
Figure 4:
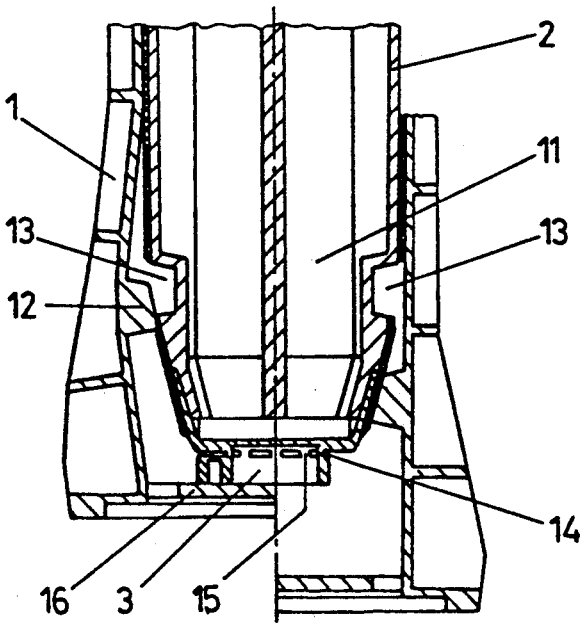
Figure 5:
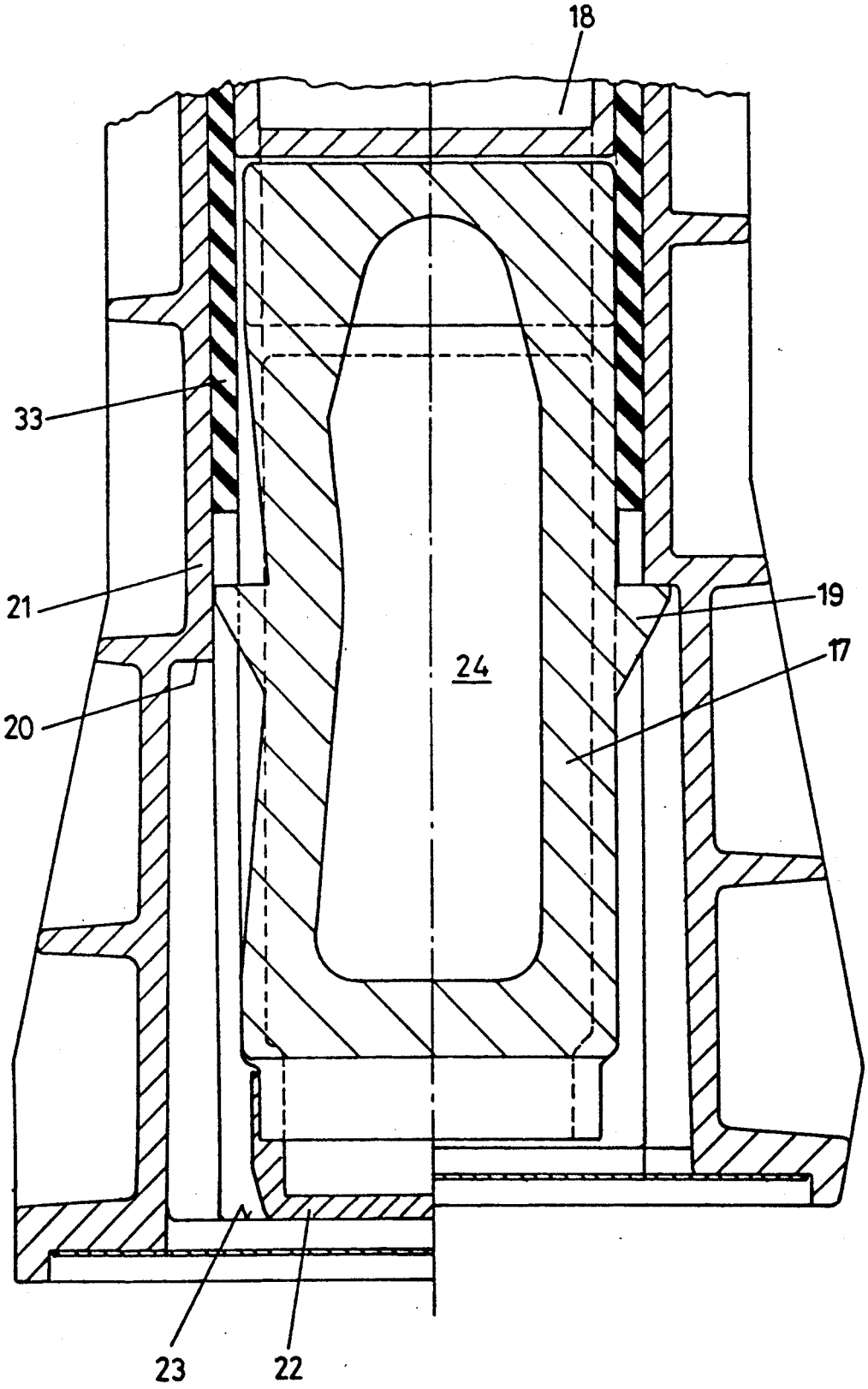
Figure 6:
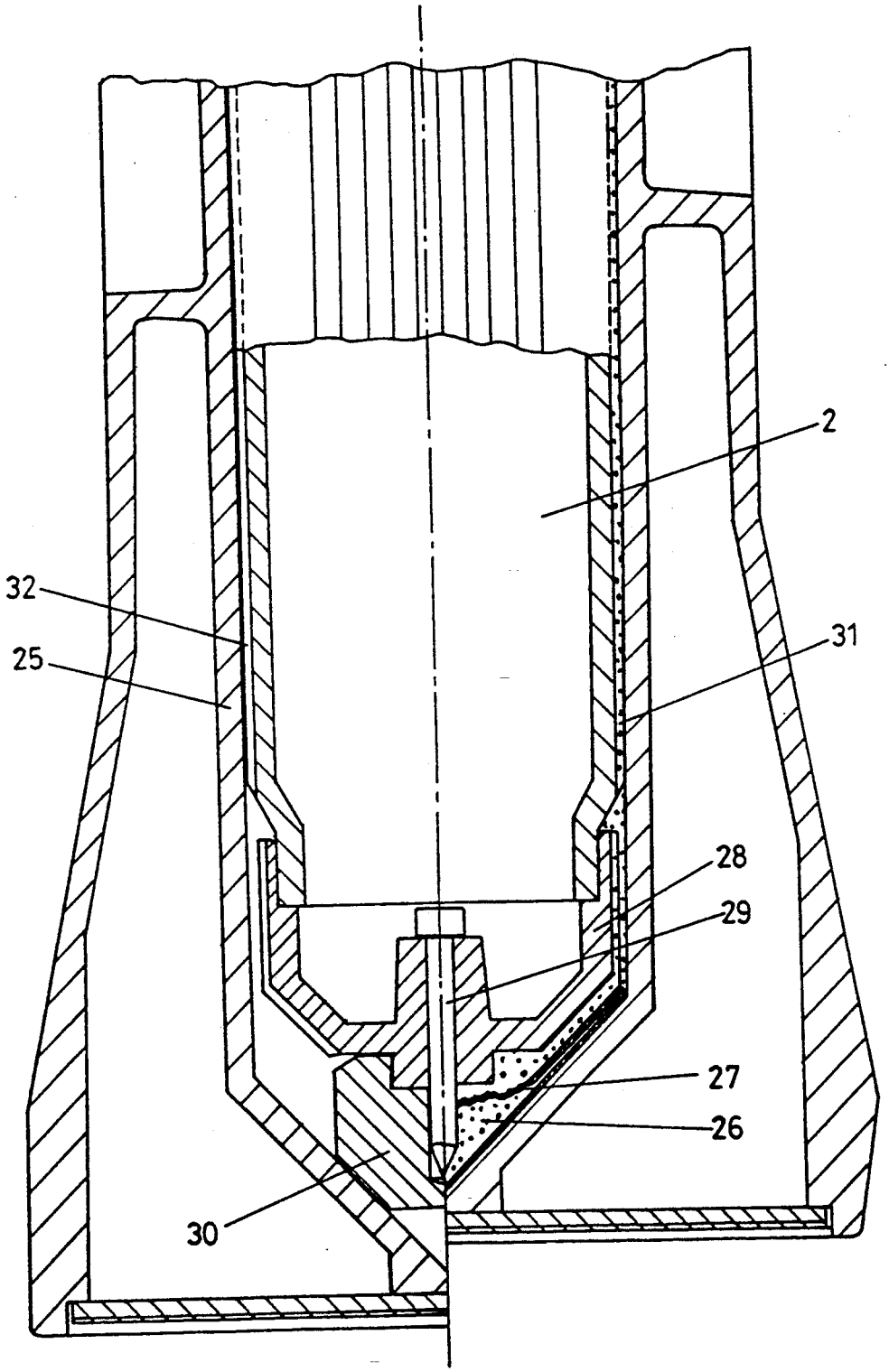

The present invention will be described in greater detail on the basis of the drawings appended hereto. These drawings show the following:

FIGS. 1, 2 and 3: the grip and the shaft in the mated position with the distance piece removed;

FIG. 1: a longitudinal section on the line I—I in FIG. 2;

FIG. 2: a cross section on the line II—II in FIG. 1;

FIG. 3: a cross section on the line III—III in FIG. 1;

FIG. 4: the end of the shaft and the end of the grip as in FIG. 1 in the position used for the trial with the distance piece being in position;

FIGS. 5 and 6: modified embodiments wherein the end of the grip and the end of the shaft are shown, on the left, in position with the distance piece acting as in a trial and, on the right, in the mated position with the distance piece removed.

In the position shown in FIGS. 1, 2 and 3, the grip 1 has been slid onto the shaft 2 all the way into the mated position, and the distance piece 3 (FIG. 4) has already been removed. The shaft 2 incorporates supporting surfaces 4, 5, 6, and the grip 1 incorporates supporting surfaces 7, 8, 9 which, in the mated position, fit snugly together, with a foil 10 interposed between them. On the one hand, such a foil 10 results in very close contact and provides a certain damping effect when the racquet strikes a ball. The spacing between the supporting surfaces 4, 5, 6 on the shaft 2 and the spacing between the supporting surfaces 7, 8, 9 on the shaft 1 is identically wedge-shaped to the whole length of the grip 1 and they taper equally towards the unattached end 11 of the shaft. The angle of this taper amounts to approximately 1°, and this ensures self-locking rigid seating.

On the grip 1, there are diametrically opposed lugs 12 that extend inwards, and which, in the fully installed mated position, snap into the transverse groove 13 on the shaft 2. The axial extent of the lugs 12 equals the axial extent or width, respectively, of the groove 13, so that when in the mated position the grip 1 is secured to the shaft 2 so as to be secured in both axial directions. Since the lugs 12 are not accessible when in the mated position shown in FIG. 1, the connection between shaft 2 and grip 1 is for all practical purposes unreleasable when in the mated position.

As is shown in FIG. 4, the distance piece 3 is connected to the unattached end 11 of the shaft through an interposed nominal break section 14. This nominal break point is formed by an annular groove and perforations 15. As long as this distance piece 3 is arranged on the end 11 of the shaft, the grip 1 can only be slid onto the shaft 2 as far as a position in which the distance piece 9 lies against the stop surface 16 of the grip 1. This is the case during a test, and this position is shown in the left-hand portion of FIG. 4. In this position, as is shown in the left-hand portion of FIG. 4, the lugs 12 cannot snap into the transverse groove 8 and thus the grip 1 can still be removed from the shaft 2 after the trial. The right-hand portion of FIG. 4 shows the position of the grip 1 on the shaft 2 before the distance piece 3 lies against the stop surface 12. This position, too, is possible prior to the trial and is even to be preferred, because in this position, which is shown in the right-hand portion of FIG. 4, it is easier to remove the grip 1 from the shaft 2. All that is important is that the distance piece 3 prevents the lugs 12 from snapping into the groove 13 for the last time as long as the grip 1 is not to be secured permanently in the mated position.

Only after a satisfactory trial is the distance piece 3 broken off from the end 11 of the shaft, which can be done very easily because of the nominal break section 14, whereupon the grip 1 is driven onto the shaft 2, into the mated position shown in FIG. 1, in which the grip 1 is installed securely on the shaft 2 so as to be unremovable for all practical purposes.

In the embodiment shown in FIG. 5, the unattached end piece 17 of the shaft 18 is of elastically deformable material and is secured to the shaft 18, for example, by adhesives. Two diametrically opposed lugs 19 are arranged on the end piece 17 and work in conjunction with an annual shoulder 20 in the grip 21. Because of the distance piece 22 that is installed on the end 17 of the shaft, and which works in conjunction with a stop surface 23 of the grip 21, in the trial position shown on the left, the lugs 19 are prevented from snapping into position behind the shoulder 20. After a successful test, the distance piece 22 is removed from the end 17 of the shaft, and the lugs 19 can snap behind the shoulder 20, into the mated position, as is shown on the right-hand side. Deformation of the shaft end 17 is made simpler because of a hollow chamber 24 in the end of the shaft. In this embodiment, between the shaft 18 or the end piece 17 itself, respectively, and the grip 21, there is an elastic intermediate layer 33, for example of rubber. This elastic intermediate layer is joined rigidly to the shaft 17, 18, for example, cemented in place, and provides a certain damping effect when the racquet strikes a ball.

FIG. 6 shows an embodiment in which, when in the mated position, the grip 25 is cemented to the shaft 2. Within the grip 25 there is a capsule or bag 27 that is filled with adhesive 26. A part 28 is rigidly connected to the end of the shaft 2 and this part incorporates a pointed pin or a cutter 29. Because of a distance piece 30 that is installed on the part 28, in the trial position that is shown on the left, the pin or the cutter 29 is prevented from cutting or puncturing the bag of adhesive 27. After removal of the distance piece 30, the pin or blade 29 can cut or puncture the bag or capsule 27, as is shown on the right, whereupon the adhesive 26 can escape and penetrate the gap 31 between the shaft and the grip.

In this embodiment, in the mated position, adhesive must enter the gap 31 although, in the trial position shown on the left, the grip 25 must be so firmly installed that the racquet can be tested. For this reason, the shaft 2 incorporates longitudinal ribs 32. Because of these longitudinal ribs 32 the grip 25 is guided on the shaft 2 during the trial and is held sufficiently firmly for the test, whereas in the mated position, the adhesive can flow into the gap 31 between these ribs.

We claim:

1. A racquet comprising a frame; and open or closed heart piece; the frame, heart piece and shaft being manufactured as one piece or being connected to each other so as to be fixed; and a grip that is formed as a one-piece sleeve that can be slid onto the shaft and secured thereon when in the fully installed mated position, the inside profile of the cross section of the grip and the outside profile of the cross section of the shaft incorporating supporting surfaces that are a shape-locking fit with each other and extend longitudinally over at least part of the length of the shaft, by means of which the grip is secured on the shaft in such a manner that it cannot rotate independently of said shaft, and wherein, on the one hand, the supporting surfaces of the shaft and, on the other hand, the supporting surfaces of the grip converge in a wedge shape at least over a part of the length of the grip in the direction of the unattached end of the shaft and the supporting surfaces of the grip are parallel to the wedge surfaces of the shaft that work in conjunction with them; and wherein between the shaft and the grip there is a distance piece which is removable and which limits the axial installation movement of the grip and complete installation of the grip in the mated position.

2. A racquet as defined in claim 1, wherein the distance piece is connected to the shaft or the grip so as to be releasable.

3. A racquet as defined in claim 1, wherein the distance piece is releasably connected to the unattached end of the shaft and is supportable against a stop surface of the grip.

4. A racquet as defined in claim 1, wherein the distance piece (3) is connected to the unattached end of the shaft (2) through a nominal break cross section (14).

5. A racquet as defined in claim 1 wherein the distance piece is set onto the unattached end of the shaft or is plugged into the unattached end of the shaft.

6. A racquet as defined in claim 1 wherein the grip is connectable to the shaft so as to be unreleasable or releasable only with difficulty only after removal of the distance piece, by way of means for securing the grip and shaft together.

7. A racquet as defined in claim 1 wherein two, diametrically opposed lugs are formed on the inside surface of the grip and at least one groove is formed transversely to the axis on the shaft the grip consisting of elastically deformable material.

8. A racquet as defined in claim 7, wherein the lug and the groove are defined axially by defining surfaces that are transverse to the axis of the shaft and the spacing of the defining surfaces of the lug corresponding to the spacing of the defining surfaces of the groove.

9. A racquet as defined in claim 1, wherein the unattached end of the shaft is hollow, consists of elastically deformable material, and incorporates two, diametrically opposed lugs that snap into position behind a step that is formed on the inside surface of the grip.

10. A racquet as defined in claim 1, wherein within the grip there is a capsule or a bag that contains a quantity of adhesive and after removal of the distance piece when the grip is slid on into the mated position, this is destroyed by a blade or a pointed pin that is arranged on the end of the shaft.

11. A racquet as defined in claim 1, wherein the angle of taper that is subtended between the supporting surfaces is self-locking.

12. A racquet as defined in claim 1, wherein the angle of taper subtended between the supporting surfaces is at most 3°.

13. A racquet as defined in claim 1, the distance piece is so dimensioned that the installation path of the grip as far as the stop on the distance piece is at least 98%, of the total installation path into the mated position when the distance piece has been removed.

14. A racquet as recited in claim 13, wherein the distance piece is so dimensioned that the installation path of the grip as far as the stop on the distance piece is 99%.

15. A racquet as defined in claim 1, wherein the shaft and the hollow space within the space are of elliptical or octagonal cross section.

16. A racquet as recited in claim 1, wherein the angle of taper subtended between supporting surfaces is approximately 1°.

* * * * *